United States Patent [19]

Riseberg

[11] Patent Number: 4,539,505

[45] Date of Patent: Sep. 3, 1985

[54] CANDOLUMINESCENT ELECTRIC LIGHT SOURCE

[75] Inventor: Leslie A. Riseberg, Sudbury, Mass.

[73] Assignee: GTE Laboratories Incorporated, Waltham, Mass.

[21] Appl. No.: 489,879

[22] Filed: Apr. 29, 1983

[51] Int. Cl.[3] ..... H01K 1/32

[52] U.S. Cl. ..... 313/315; 313/345; 313/491; 315/112

[58] Field of Search ..... 250/337, 384.1; 313/491, 315, 345; 315/50, 112, 115

[56] References Cited

U.S. PATENT DOCUMENTS

| | | | |
|---|---|---|---|
| 616,276 | 12/1898 | Thowless | 313/315 |
| 844,778 | 2/1907 | Cazin | 313/315 |
| 929,280 | 7/1909 | Broadwell et al. | 313/315 |
| 1,023,485 | 4/1912 | Thowless | 313/345 |
| 1,406,645 | 2/1922 | Heany | 313/345 X |
| 3,973,155 | 8/1976 | Warren et al. | 313/345 |
| 4,016,446 | 4/1977 | Cadoff | 313/345 |

*Primary Examiner*—Saxfield Chatmon
*Attorney, Agent, or Firm*—J. Stephen Yeo

[57] ABSTRACT

An electric lamp has a candoluminescent filament. The filament has a resistive core which is heated electrically. Infrared radiation emitted by the resistive core is converted to visible light by a sheath of candoluminescent material surrounding the resistive core. The filament may be a sintered composition of carbon, ceric oxide and thorium dioxide. Carbon proximate to the surface of the filament is removed by oxidation, leaving a closed pore structure of candoluminescent material.

6 Claims, 2 Drawing Figures

CANDOLUMINESCENT ELECTRIC LIGHT SOURCE

BACKGROUND OF THE INVENTION

This invention pertains to electric lamps and, more particularly, is concerned with electric filament lamps.

The phenomenon of candoluminescence has been known for the last hundred years and was utilized in the so-called "Auer" or "Wellsbach" gas mantle which, when exposed to the heat of a flame, emits light of a color temperature far in excess of the nominal flame temperature. Thus, the insertion of such a mantle into a gas flame provides a visible light level far greater than that characteristic of the flame by itself. Early in the application of the gas mantle a mixture of $CeO_2$ and 99% $ThO_2$ was identified as an efficient and effective candoluminescent material.

While the gas mantle has a long history of application, the principle of candoluminescence has been definitively elucidated only recently. It is now believed that candoluminescent material fluoresces when excited by thermal radiation. The emitted radiation for a given temperature is shifted to shorter wavelengths than would be expected from the ideal black body distribution to provide a greater percentage of visible light at a given temperature and, correspondingly, less energy supplied to the emitting medium to maintain the radiator at a temperature to provide the same black body intensity in the visible.

The utilization of a candoluminescent medium to change incandescent spectral energy distribution and, therefore, the increasing efficacy of an incandescent source would provide major savings in energy resources.

For a better understanding of the present invention, reference is made to the following disclosure and appended claims in connection with the above-described drawings.

DESCRIPTION OF THE INVENTION

Figure 1:
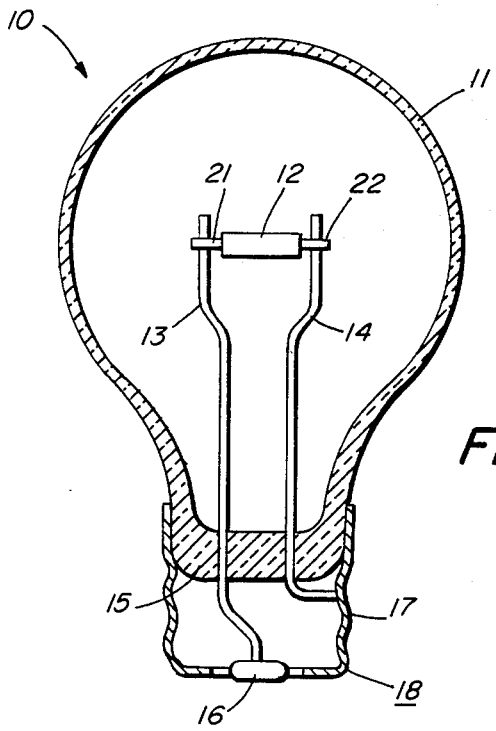
FIG. 1 is a cross-sectional view of a lamp embodying the invention.

FIG. 1 shows in cross section an electric lamp 10 embodying one aspect of the invention. A light passing envelope 11 encloses a filament 12. The filament is supported by lead-in wires 13, 14 which pass through a seal 15 and are connected to terminals 16, 17 on a base 18 cemented to the outside of the envelope 11.

Figure 2:
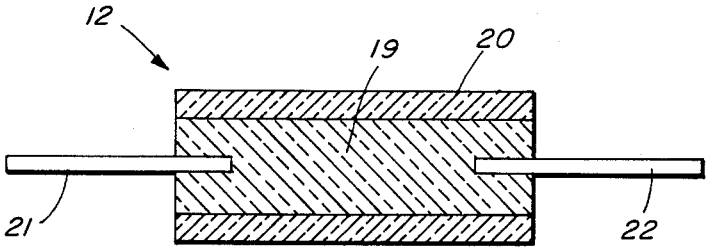
FIG. 2 illustrates in cross section a filament first seen in FIG. 1.

As a feature of the invention, the filament 12 has a resistive core 19 surrounded by a candoluminescent sheath 20, as shown in FIG. 2.

The resistive core 19 of the filament 12 is preferably a sintered composition of carbon, ceric oxide ($CeO_2$), and thorium dioxide ($ThO_2$). The candoluminescent sheath 20 is preferably a sintered composition of ceric oxide ($CeO_2$) and thorium dioxide ($ThO_2$).

The filament may be made by first ball milling a mixture of carbon, $CeO_2$, and $ThO_2$, with $Y_2O_3$ as a sintering aid. Water is added to the milled mixture and the resultant slurry is extruded or molded into a homogeneous cylindrical rod which is sintered by heating in a reducing or inert atmosphere for several hours. After sintering, the rod is heated in an air furnace until carbon near the surface of the rod is oxidized and removed, leaving behind a carbon free sheath 20 of candoluminescent material with closed porosity.

Carbon below the surface layer of the rod is retained during the air firing and remains to be a component of the resistive core 19. There is no finite space between the sheath 20 and the core 19 assuring good thermal coupling between the regions.

In order to make electrical connection to the resistive core 19, wires 21, 22 made of refractory metal having matching thermal coefficients are sintered into each end of the resistive core. The wires 21, 22 may be welded to the lead-in wires 13, 14 as seen in FIG. 1.

When current is passed through the resistive core 19, it heats to a temperature determined by the equilibrium between the core 19 and its environment. Energy losses include whatever heat is lost conductively through the connections 21, 22 and whatever energy is lost radiatively from the outside surface of candoluminescent sheath 20.

Infrared radiation from core 19 excites the electrons of the candoluminescent materials in sheath 20 which, upon reversion to more stable levels, emit radiation in visible wavelengths. The energy lost radiatively will, therefore, be emitted principally in the visible wavelength region, eliminating the infrared radiated energy that is the dominant mode of energy loss in a conventional incandescent lamp.

Carbon itself is a well-known filament material used in early incandescent lamps and can be utilized at very high temperatures. $CeO_2$ and $ThO_2$ are both refractory and candoluminescent. $CeO_2$, however, has high visual and infrared emissity and alone radiates too much heat to give a high visible output. $ThO_2$ on the other hand has relatively low thermal emissity and is a poor heat radiator. By using a mixture of $CeO_2$ and $ThO_2$, the core 19 can reach a temperature which provides a radiosity curve nominally with a peak in the 1 to 2 m region if it were an ideal black body. However, most of the heat loss will be converted to visible radiation because of the candoluminescent sheath 20. Accordingly, the energy required to operate a candoluminescent filament is significantly less than for an incandescent filament emitting equivalent visible light output.

While there has been shown and described what is at present considered the preferred embodiment of the invention, it will be obvious to those skilled in the art that various changes and modifications may be made therein without departing from the scope of the invention as defined by the appended claims.

I claim:

1. An electric lamp comprised of:

a light passing envelope;

at least two lead-in wires extending from the exterior to the interior of said envelope;

a filament supported within said envelope by said lead-in wires, said filament including a resistive core electrically coupled to said lead-in wires; and a candoluminescent sheath at least partially surrounding said core; wherein said resistive core is a sintered composition including carbon, ceric oxide, and thorium dioxide; and said candoluminescent sheath is a sintered composition including ceric oxide and thorium dioxide.

2. The electric lamp of claim 1 wherein there is no finite space between said resistive core and said candoluminescent sheath.

3. The electric lamp of claim 2 which further includes wires of refractory metal sintered in said resistive core and connected to said lead-in wires.

4. A filament for use in electric lamps comprised of:

a resistive core; and a candoluminescent sheath surrounding said core; wherein said resistive core is a sintered composition including carbon, ceric oxide, and thorium dioxide; and said candoluminescent sheath is a sintered composition including ceric oxide and thorium dioxide.

5. The filament of claim 4 wherein there is no finite space between said resistive core and said candoluminescent sheath.

6. The filament of claim 5 which further includes wires of refractory metal sintered in said resistive core.

* * * * *